United States Patent [19]

Boyden

[11] 4,006,336

[45] Feb. 1, 1977

[54] NORMALLY CLOSED WAFER THIN SWITCH

[75] Inventor: Robert E. Boyden, Bethel Island, Calif.

[73] Assignee: Fred N. Schwend, Arcadia, Calif. ; a part interest

[22] Filed: June 2, 1975

[21] Appl. No.: 582,751

[52] U.S. Cl. ..... 200/246; 340/280; 200/159 A

[51] Int. Cl.[2] ..... H01H 1/24

[58] Field of Search ..... 200/159 A, 86 R, 86.5, 200/59 A, 61.93, 51.1, 85 R, 61.1, 61.11, 61.84, 61.62, 1 TK, 1 B, 1 V, 61.61, 61.78, 61.81, 61.83, 239, 242, 245, 246, 248, 275, 159 R, 61.45 R; 340/276, 280, 272, 274, 283

[56] References Cited

UNITED STATES PATENTS

| | | | |
|---|---|---|---|
| 259,825 | 6/1882 | Davis | 200/159 A |
| 1,159,701 | 12/1915 | Neahr | 200/51.1 |
| 2,626,388 | 1/1953 | Needleman | 200/85 R X |

FOREIGN PATENTS OR APPLICATIONS

| | | | |
|---|---|---|---|
| 81,760 | 10/1894 | Germany | 200/159 R |

*Primary Examiner*—Robert K. Schaefer
*Assistant Examiner*—Morris Ginsburg
*Attorney, Agent, or Firm*—Fred N. Schwend

[57] ABSTRACT

A normally closed wafer thin switch, particularly intended for pilferage type burglar alarms, comprising a flat base plate of insulating material having an opening therein and a pair of leaf spring contacts attached to one peripheral portion of the plate and extending over the opening. Free ends of the contacts normally engage each other to complete a circuit. A raised tab on a first of the contacts overlies an opposite peripheral portion of the plate whereby, when an object is placed on or against the switch, the tab is depressed against the plate, causing opening of the switch.

5 Claims, 4 Drawing Figures

FIG. 1.
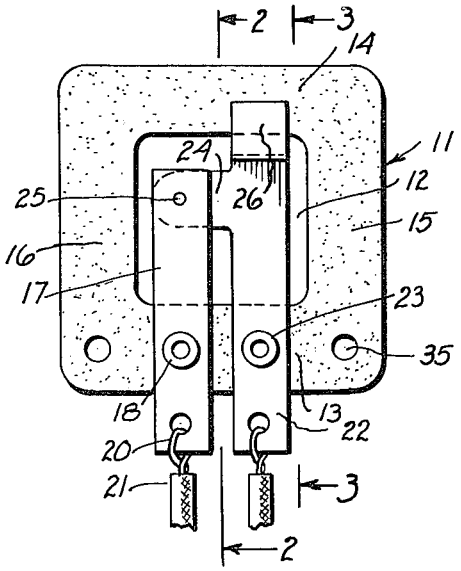
FIG. 2.
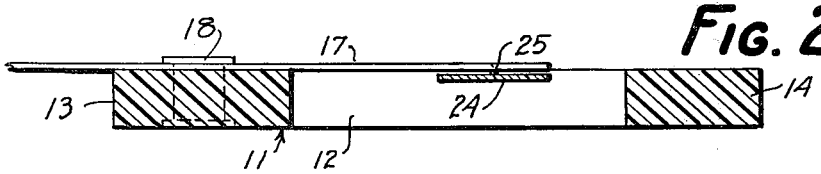
FIG. 3.
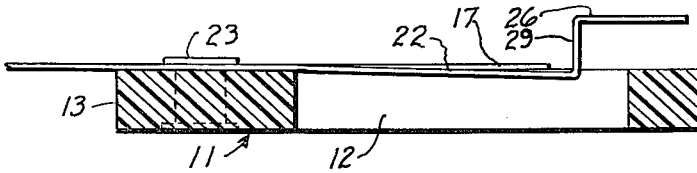
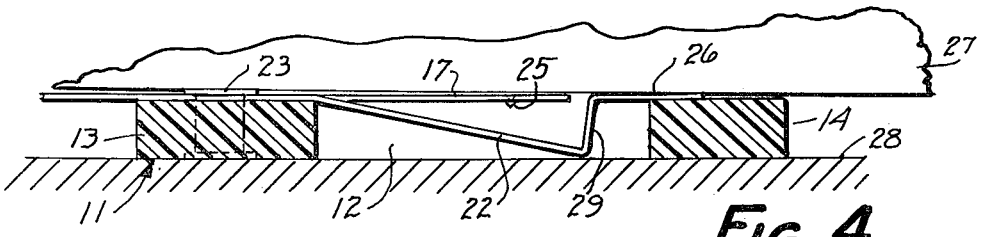
FIG. 4.

NORMALLY CLOSED WAFER THIN SWITCH

BACKGROUND OF THE INVENTION

Field of the Invention

This invention relates to switches and has particular reference to pilferage detecting switches intended for burglar alarms or the like.

In pilferage type burglar alarms, small and unobtrusive switches are placed under certain selected objects and are connected in circuit with an alarm system so that when an object is removed the alarm will be set off. Heretofore, such switches were constructed as normally open switches in order to make them as thin as possible and, as such, generally comprised two separate leaf spring contacts which, when an object was placed thereon, closed a circuit and when the object was removed, opened the circuit.

Although such switches work satisfactory, they require a normally completed alarm circuit, i.e., a circuit which, when in a quiescent state, requires constant electric current to be passed therethrough and which, when the circuit is broken, sets off an alarm.

As is well known, it is normally desirable to employ self-contained burglar alarm circuits, using batteries as the power source, so that cutting of the power lines will not deactivate the alarm circuit. Therefore, in using switches of the above normally open type, a constant current drain is applied to the batteries, requiring repeated replacement or recharging thereof.

STATEMENT OF THE INVENTION

A principal object of the present invention is to provide a normally closed wafer thin type switch.

Another object is to provide a normally closed wafer thin switch which may be opened by light pressure and yet is capable of withstanding extremely heavy loads without damage.

Another object is to provide a small, simple and inexpensive normlly closed wafer thin switch.

Another object is to provide a normally open wafer thin switch in which the contacts are self-cleaning.

According to the present invention, a normally closed wafer thin switch is provided which will open when an object is placed thereon or thereagainst and which closes when the object is removed. Therefore, the switch can be used in a normally open alarm circuit in which there is no current drain when the alarm is in a quiescent state.

The switch comprises a thin base plate of insulating material having an opening therein. A pair of flexible leaf contacts are secured against the upper surface of one peripheral portion of the plate. The contacts extend in parallel relation over the opening with a portion of one of the contacts being offset and normally underlying the other to complete an electrical circuit across the contacts. A first contact has a raised tab thereon which overlies an opposite peripheral portion of the base plate so that when an object is placed upon or against the switch, the tab will engage such opposite peripheral portion and the contacts will become electrically disconnected. It will be seen that an extremely heavy object may be placed on or against the switch without danger of crushing or otherwise damaging the same.

Due to the offset contact portion on one of the contacts and the resiliency of both contacts a slight twisting action occurs about a line extending along the length of such one contact which results in a relative wiping movement between the contacts which tends to remove any oxides or dirt therebetween.

BRIEF DESCRIPTION OF THE DRAWINGS

The manner in which the above and other objects of the invention are accomplished will be readily understood on reference to the following specification when read in conjunction with the accompanying drawings wherein:

FIG. 1 is an enlarged plan view of a switch embodying a preferred form of the present invention.

FIG. 2 is a greatly enlarged transverse sectional view taken along the line 2—2 of FIG. 1.

FIG. 3 is another greatly enlarged transverse sectional view taken along the line 3—3 of FIG. 1, illustrating the switch in its normal closed condition.

FIG. 4 is a transverse sectional view similar to FIG. 3 but illustrating the switch in an open condition.

DESCRIPTION OF THE PREFERRED EMBODIMENT

Referring to the drawings, the switch comprise a flat base plate 11 of relatively rigid insulating material such as phenolic plastic. Such plate is relatively small, being on the order of 1 inch square or less and preferably 0.060 to 0.078 inches thick. A substantially square opening 12 is formed through plate 11, being defined by opposing peripheral portions 13, 14 and 15, 16.

A relatively stiff elongate leaf spring contact 17 of metal, such as phosphor bronze and having a thickness on the order of 0.010 inches is secured to the upper surface of peripheral plate portion 13 by a rivet 18.

The free end of contact 17 extends over the opening 12 and terminates short of the peripheral plate portion 14. The opposite of contact 17 is electrically connected at 20 to an electrical conductor 21.

A second relatively flexible leaf spring contact 22 of metal, which may also be of phosphor bronze, and having a thickness on the order of 0.007 inches is secured to the upper surface of peripheral plate portion 13 by a rivet 23 in side-by-side relation with contact 17. The free end of contact 22 has an offset portion 24 which extends under the free end of contact 17 and normally engages a downwardly projecting dimple 25 formed on contact 17, as shown in FIG. 2 to complete a circuit across the contact. The free end of contact 22 is also bent upwardly at 29 and then horizontally to form a tab 26 which overlies the peripheral plate portion 14 and is normally spaced thereabove a distance substantially equal to the thickness of the plate 11.

Preferably, both contacts 17 and 22 are plated with silver or other conductive metal having a low electrical resistance characteristic and a high resistance to formation of oxides thereon.

When the switch is laid against a supporting surface 28, as seen in FIG. 4, and an object 27 is placed on the upper surface thereof, it will depress the tab 26 until the latter engages the upper surface of the peripheral plate portion 14, thereby deflecting the contact 22 to disengage the same from contact 17 and thus open the electrical circuit thereacross. When the object 27 is lifted or otherwise removed, the contact 22 will spring upward to reengage contact 17 and thus complete the circuit and the two contacts.

The upper surface of contact 22, and particularly tab 26, may be coated or otherwise covered with a suitable insulating material (not shown) so that metal objects may be placed thereon without shorting across the contacts 17 and 22.

Holes 35 are formed in the base plate 11 to enable the same to be attached by screws or the like (not shown) to a floor or wall surface.

It will be noted that the switch may operate equally well when mounted in upside-down condition, i.e. with the tab 26 in engagement with the supporting surface 28, as long as the base 11 is not attached to such surface.

Due to the laterally offset contact portion 24 of contact 22, the latter will twist slightly about a line passing along the length thereof, when the contacts are opened and closed, thereby causing a slight relative wiping action between the contact dimple 25 and the contact portion 24. Such action will clean the engaging contact surfaces of any products of oxidation or dirt which might otherwise prevent proper operation of the switch.

I claim:

1. A normally closed switch comprising a thin flat base plate of insulating material, said base plate having an opening therethrough and a peripheral portion surrounding said opening, a first elongate leaf spring contact, means securing said contact to the upper surface of said peripheral portion, a free end of said contact being aligned with said opening, a second elongate leaf spring contact, means securing said second contact to the upper surface of said peripheral portion, a free end of said second contact having a contact portion aligned with said opening and extending under said first contact and normally in engagement therewith, said free end of said second contact extending above the level of said upper surface of said base plate whereby to depress said contact portion into said opening to break said engagement when said free end of said second contact is depressed.

2. A normally closed switch as defined in claim 1 wherein said free end of said second contqct has a portion overlying said peripheral portion and at least substantially parallel to said upper surface thereof whereby to limit downward movement of said free end.

3. A normally closed switch comprising a thin flat base plate of insulating material, said base plate having an opening therethrough and a peripheral portion surrounding said opening, a first elongate leaf spring contact, means securing said contact to the upper surface of said peripheral portion at one side of said base plate, a free end of said contact being aligned with said opening, a second elongate leaf spring contact, means securing said second contact to said upper surface of said peripheral portion at said one side of said base plate, a free end of said second contact having a contact portion aligned with said opening and extending under said first contact and normally in engagement therewith, said free end of said second contact having a portion overlying said peripheral portion at the opposite side of said base plate whereby to depress said contact portion into said opening to break said engagement when said free end of said second contact is depressed, and said overlying portion extending substantially parallel to the upper surface of said base plate.

4. A normally closed switch as defined in claim 3 wherein said last mentioned portion extends above said peripheral portion an amount substantially equivalent to the thickness of said base plate.

5. A normally closed switch as defined in claim 3 wherein said first contact is relatively stiffer than said second contact.

* * * * *